United States Patent [19]

Imai et al.

[11] 4,213,693

[45] Jul. 22, 1980

[54] ELECTROSTATOGRAPHIC APPARATUS COMPRISING IMPROVED DEVELOPING BIAS CONTROL

[75] Inventors: Chikara Imai; Susumu Tatsumi; Tadahiro Eda, all of Tokyo, Japan

[73] Assignee: Ricoh Company, Ltd., Tokyo, Japan

[21] Appl. No.: 5,714

[22] Filed: Jan. 23, 1979

[30] Foreign Application Priority Data

Jan. 25, 1978 [JP] Japan ..... 53-6801

[51] Int. Cl.[2] ..... G03G 15/00

[52] U.S. Cl. ..... 355/14 D; 118/668; 355/3 DD; 355/10

[58] Field of Search ..... 355/3 R, 3 DD, 10, 14 R, 355/14 D; 118/665, 668, 691, 693; 430/30

[56] References Cited

U.S. PATENT DOCUMENTS

| | | | |
|---|---|---|---|
| 4,035,071 | 7/1977 | Miyakawa et al. | 355/10 |
| 4,050,806 | 9/1977 | Miyakawa et al. | 355/10 X |
| 4,087,171 | 5/1978 | Yano | 355/10 X |
| 4,139,299 | 2/1979 | Miyakawa et al. | 355/10 |

*Primary Examiner*—Fred L. Braun

*Attorney, Agent, or Firm*—David G. Alexander

[57] ABSTRACT

A photoconductive drum (12) is electrostatically charged and radiated with a light image of an original document (16) to form an electrostatic image. The average value of the electrostatic potential of the electrostatic image is sensed and a developing bias voltage controlled in accordance therewith. The bias voltage is progressively increased when the sensed electrostatic potential is below a predetermined value and is reduced to a lower value when the electrostatic potential exceeds the predetermined value. The electrostatic potential is below the predetermined value for original documents constituted by printed pages and above the predetermined value for original documents constituted by photographs and other continuous tone documents.

9 Claims, 11 Drawing Figures

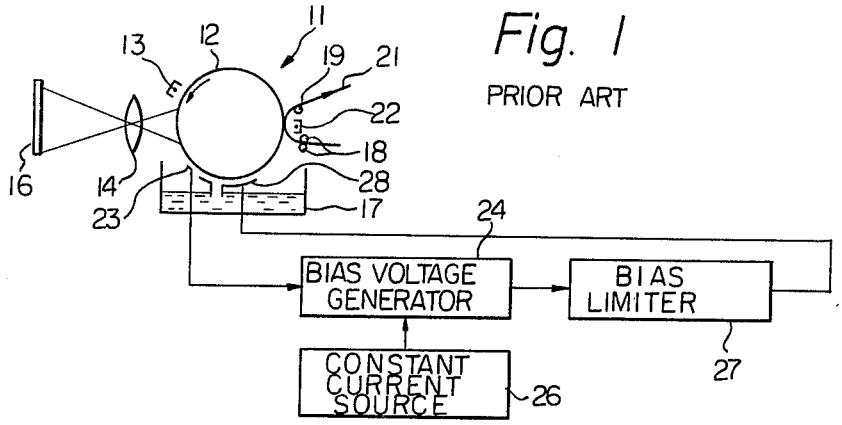
Fig. 1
PRIOR ART
Fig. 2
PRIOR ART
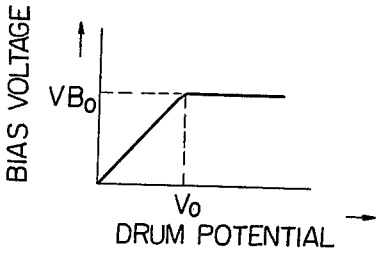
Fig. 3
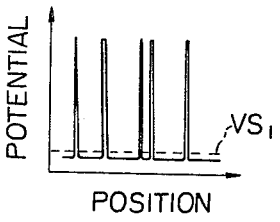
Fig. 4
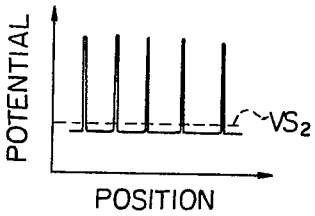
Fig. 5
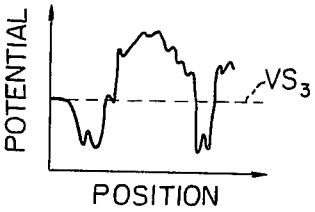

ELECTROSTATOGRAPHIC APPARATUS COMPRISING IMPROVED DEVELOPING BIAS CONTROL

BACKGROUND OF THE INVENTION

The present invention relates to an electrostatographic apparatus such as an electrostatic copying machine. It is desirable for an electrostatic copying machine to produce good copies of all types of original documents including printed pages and photographs. However, such copying machines known heretofore have generally been able to produce good copies only of printed pages. When these copying machines produce copies of photographs having large dark areas, the dark areas tend to appear washed out and the copy contrast is very low. Such copies are completely unsatisfactory.

It is known in the art to control a bias voltage applied during development in accordance with the sensed potential of an electrostatic image of an original document formed on an electrostatic drum or belt. The bias voltage is adjusted to be equal to or slightly above the potential of the background areas of the electrostatic image. This prevents toner transfer to the background image areas during development and ensures clean white background areas in the copy.

The background areas of the electrostatic image will not have zero potential even if the background areas of the original document are pure white. The background areas of the electrostatic image will have a residual potential which is a function of fatigue of the photoconductive coating on the drum or belt, deterioration of an imaging light source, contamination of mirrors and lenses in an exposure optical system and the like. In addition, due to the spectral sensitivity of the drum the background electrostatic potential for electrostatic images of documents having different colored backgrounds will differ as a function of the color.

The known system is generally operative to adjust the developing bias voltage to an optimum value regardless of all variations in the above mentioned parameters where the document is a printed page. However, photographic documents or documents having white printing on dark backgrounds are not reproduced satisfactorily with such a system. The bias voltage will be set to an excessive value causing the dark areas to be washed out and the contrast to be extremely low.

A proposed expedient to allow copying of photographic documents is disclosed in Japanese patent application no. 49-81884 and patent application publication no. 51-950. This expedient is to limit the maximum bias voltage to a predetermined value. Although it improves the copy quality and reduces the washing out of dark image areas in copies of photographic documents, the copies produced by such a system are still not faithful reproductions of the original documents.

SUMMARY OF THE INVENTION

An electrostatographic apparatus embodying the present invention includes a photoconductive member, charging means for forming an electrostatic charge on the photoconductive member, imaging means for radiating a light image onto the photoconductive member to form an electrostatic image thereon and developing means for applying toner to the photoconductive member to develop the electrostatic image into a toner image. Sensing means sense an electrostatic potential of the electrostatic image on the photoconductive member. Bias voltage generating means generate and apply a developing bias voltage to the developing means. Control means responsive to the sensing means control the generating means in such a manner as to increase the bias voltage in accordance with the electrostatic potential until the electrostatic potential reaches a predetermined value and to decrease the bias voltage when the electrostatic potential exceeds said predetermined value.

It is an object of the present invention to provide an electrostatographic apparatus which is capable of producing faithful reproduction of all types of original documents including printed documents and photographs.

It is another object of the present invention to provide an electrostatographic apparatus comprising improved means for optimally controlling a developing bias voltage.

It is another object of the present invention to provide an electrostatographic apparatus which overcomes a major problem regarding copy quality which has existed heretofore in the prior art.

It is another object of the present invention to provide a generally improved electrostatographic apparatus.

Other objects, together with the foregoing, are attained in the embodiments described in the following description and illustrated in the accompanying drawing.

BRIEF DESCRIPTION OF THE DRAWING

FIG. 1 is a schematic diagram illustrating a prior art electrostatographic apparatus;

FIG. 2 is a graph illustrating the operation of the apparatus of FIG. 1;

FIG. 3 is a graph illustrating sensed electrostatic image potential for a printed original document having a white background;

FIG. 4 is a graph illustrating sensed electrostatic image potential for a printed original document having a colored background;

FIG. 5 is a graph illustrating sensed electrostatic image potential for a photographic original document;

DESCRIPTION OF THE PREFERRED EMBODIMENTS

Figure 6:
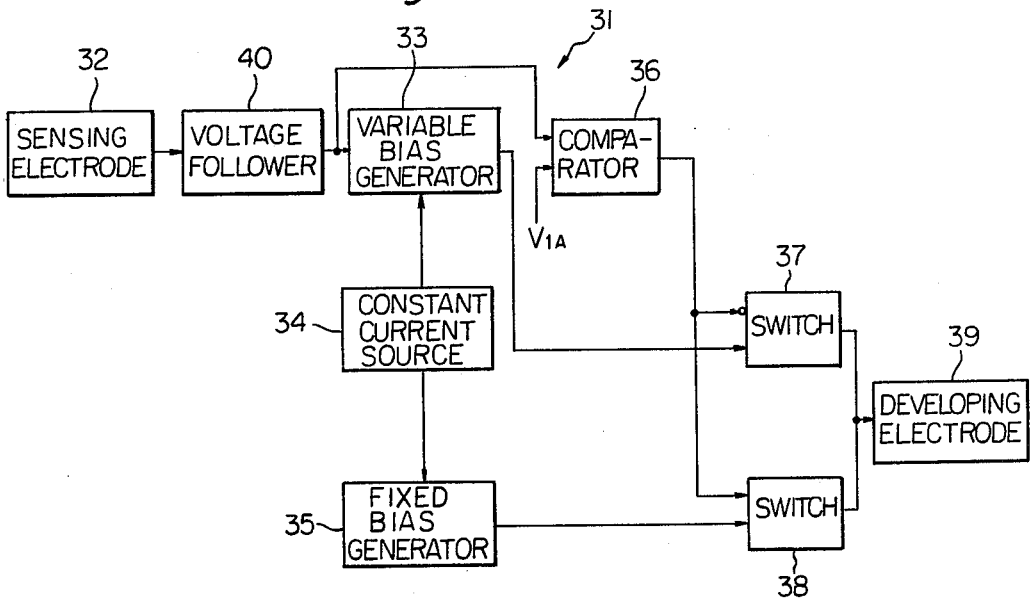
FIG. 6 is a block diagram of a first embodiment of an electrostatographic apparatus embodying the present invention.

While the electrostatographic apparatus of the present invention is susceptible of numerous physical embodiments, depending upon the environment and requirements of use, substantial numbers of the herein shown and described embodiments have been made, tested and used, and all have performed in an eminently satisfactory manner.

Referring now to FIG. 1 of the drawing a prior art electrostatographic apparatus is illustrated as being in the form of an electrostatic copying machine which is generally designated by the reference numeral 11 and comprises a photoconductive drum 12 which is rotated counterclockwise at constant speed. A charging unit 13 applies a uniform electrostatic charge to the drum 12. An imaging optical system which is symbolically illustrated as being in the form of a converging lens 14 radiates a light image of an original document 16 onto the drum 12 to form an electrostatic image through localized photoconduction. A developing unit 17 applies toner to the drum 12 to develop the electrostatic image into a toner image. Feed rollers 18 and 19 feed a copy sheet 21 into engagement with the drum 12. A transfer charger 22 applies an electrostatic charge to the back of the copy sheet 21 for transferring the toner image to the copy sheet 21. A fixing unit which is not shown fixed the toner image to the copy sheet 21 to provide a finished copy.

The apparatus 11 further comprises a sensing electrode 23 which is provided upstream of the developing unit 17 for sensing the electrostatic potential of the electrostatic image on the drum 12. Typically, the electrode 23 will be in a form which is elongated parallel to the axis of the drum 12. The instantaneous potential on the electrode 23 will be the average value of induced electrostatic potential from the drum 12 and correspond to the average potential of the electrostatic image on the drum 12.

The electrode 23 is connected to the input of a bias voltage generator 24 which is powered from a constant current source 26. The generator 24 produces an output voltage which is equal or slightly greater than the average potential of the electrostatic image on the drum 12. The generator 24 is connected through a bias voltage limiter 27 to a developing electrode 28 provided in the developing unit 17. The bias electrode 28 prevents toner transfer from the developing unit 17 to the drum 12 in electrostatic image areas in which the electrotratic potential is lower than the bias voltage which is applied to the developing electrode 28.

The operation of the apparatus 11 is illustrated in FIG. 2. It will be seen that when the sensed average electrostatic potential on the drum 12 is below a predetermined value V0 the bias voltage will be increased progressively. However, when the sensed electrostatic potential exceeds the value V0 the bias voltage will be limited to an upper limit value VB0 as shown. The bias limiter 27 typically comprises a zener diode (not shown) and the value VB0 is the zener voltage of the zener diode.

Although the apparatus 11 is operative to produce good copies of printed documents, even with colored backgrounds, it will not produce good copies of photographic documents or documents having dark backgrounds with white printing. This is because all image information having an electrostatic potential below the bias voltage will be lost.

The principle of the present invention will now be described with reference being made to FIGS. 3 to 5. It will be assumed that the drum 12 has a selenium photoconductive coating and that the charging unit 13 applies a charge of 1000VDC to the drum 12.

FIG. 3 illustrates electrostatic image potential as a function of the axial position on the sensing electrode 23 for a printed document having a white background. In order to provide a copy with a white background the bias voltage must be higher than the noise potential, the major component of which is the residual potential. This type of document has a background density less than 0.1. The dark printed letters constitute about 7% of the total area of the documents, with the remainder being white background areas. The average electrostatic potential is VS1 for this type of document, which is above the noise potential.

FIG. 4 illustrates a printed document having a colored background. Here the background density is between 0.1 and 0.3 and the printed letter area is 7% of the total image area. The electrostatic image potential VS2 is higher than the potential VS1 for a white document due to the colored background.

FIG. 5 illustrates the case of a photographic document having a continuous tone image. The average density is about 0.5 The image potential VS3 is higher than the potentials VS1 and VS2. If a bias voltage corresponding to VS3 were applied to the electrode 28 all image information having a potential below the bias voltage would be lost since it would appear completely white. The peaks in the graphs of FIGS. 3 and 4 correspond to printed letters.

In the case of the photographic document having an average density of 0.5 the bias voltage would be 500VDC. Thus, all image information below 500VDC would be lost and the dark areas would be washed out due to the low electrostatic contrast between the electrostatic image potential and the bias voltage. In the prior art apparatus 11 the situation is somewhat improved by limiting the bias voltage to an upper limit value of 400VDC. However, all information below 400VDC is lost and the dark image areas still appear washed out, although to a lesser extent.

Figure 7:
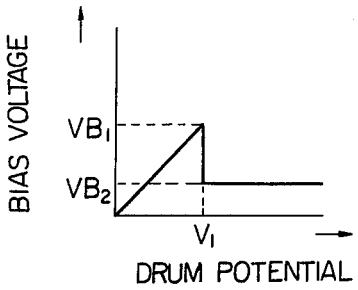
FIG. 7 is a graph illustrating the operation of the apparatus of FIG. 7.

FIG. 7 illustrates how this problem is overcome in accordance with the present invention. Rather than merely limiting the bias voltage to an upper limit value VB0 the present invention reduces the bias voltage from an upper limit value VB1 to a lower constant value VB2 when the drum potential exceeds a predetermined value V1. The upper limit value VB1 occurs at the potential V1.

It has been determined experimentally that for practically all printed documents the average electrostatic image potential will be below 400VDC. Photographic documents will produce average electrostatic image potentials above 400VDC. Thus, the value V1 is set to be 400DVC. By sensing the average electrostatic potential on the drum 12 it is determined whether the original document is printed or photographic by means of the magnitude of the average electrostatic potential. When the electrostatic potential is above 400VDC the bias voltage is automatically lowered to the constant value VB2 which is typically 100VDC. This low bias voltage VB2 ensures excellent reproduction of photographic documents. However, at average drum potentials below 400VDC the bias voltage is progressively increased to VB1 ensuring excellent reproduction of printed documents.

An electrostatographic apparatus for achieving the operation illustrated in FIG. 7 is shown in FIG. 6 and is adapted to be incorporated into an electrostatic copying machine of the type illustrated in FIG. 1. An electrostatographic apparatus 31 embodying the present invention comprises a sensing electrode 32 which is generally identical to the electrode 23 of the apparatus 11. The electrode 32 is connected through a unity gain voltage follower 40 having high input impedance of $10^{11}$ to $10^{12}$ ohms to an input of a variable bias voltage generator 33 powered by a constant current source 34. The generator 33 produces an output voltage which is proportional to the voltage on the electrode 32 and which is equal or slightly greater than the average electrostatic potential on the drum 12.

The output of the generator 33 is connected to an input of an electronic switch 37. A reference voltage V1A corresponding to the potential V1 is applied to an input of a comparator 36. The output of the follower 40 is connected to another input of the comparator 36. The output of the comparator 36 is connected to an inverting control input of the switch 37 and to a non-inverting control input of a switch 38. The output of a constant or fixed bias voltage generator 35 which is powered by the constant current source 34 and produces the fixed bias voltage VB2 is connected to another input of the switch 38. The outputs of the switches 37 and 38 are connected to a developing electrode 39 which corresponds to the electrode 28 of the apparatus 11.

When the output voltage of the follower 40 is below the voltage V1A, the comparator 36 produces a low output which closes the switch 37 and opens the switch 38. Thus, the output of the variable bias voltage generator 33 is connected to the electrode 39 through the switch 37. The bias voltage is increased to the upper limit value VB1 which occurs when the average electrostatic potential is equal to V1 and the output of the follower 40 is equal to V1A. As the potential exceeds V1 the output of the comparator 36 goes high and the switch 37 is opened while the switch 38 is closed. Thus, the output of the fixed bias voltage generator 35 is connected to the developing electrode 39. In this manner, the bias voltage will be maintained at VB2 (100VDC) for all values of average electrostatic image potential above V1.

Figure 8:
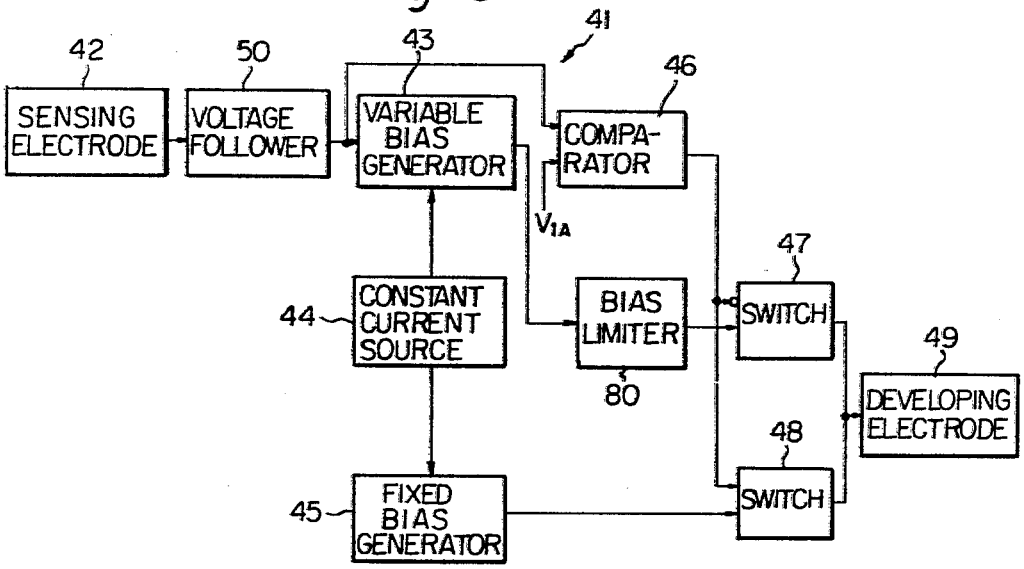
FIG. 8 is a block diagram of a second embodiment of an electrostatographic apparatus embodying the present invention.

Another electrostatographic apparatus 41 embodying the present invention is shown in FIG. 8 and comprises a sensing electrode 42 which is connected through a follower 50 to an input of a variable bias voltage generator 43 powered by a constant current source 44. The generator 43 produces an output voltage which is proportional to the voltage on the electrode 42 and which is equal or slightly greater than the average electrostatic potential on the drum 12.

The output of the generator 43 is connected to an input of an electronic switch 47. The reference voltage V1A corresponding to the potential V1 is applied to an input of a comparator 46. The output of the follower 50 is connected to another input of the comparator 46. The output of the comparator 46 is connected to an inverting control input of the switch 47 and to a non-inverting control input of a switch 48. The output of a constant voltage generator 45 which is powered by the constant current source 44 and produces the fixed bias voltage VB2 is connected to another input of the switch 48. The outputs of the switches 47 and 48 are connected to a developing electrode 49 which corresponds to the electrode 28 of the apparatus 11.

The apparatus 41 differs from the apparatus 31 in that a bias voltage limiter 80 is connected between the generator 43 and switch 47 and also in that the generator 43 is constructed such that the upper limit bias voltage VB1 is produced when the average drum potential is at a value V2 which is lower than V1. The limiter 80 functions to limit the bias voltage to the upper limit value VB1 when the drum potential is between V2 and V1. When the drum potential exceeds V1 the output of the comparator 46 goes high and the lower constant bias voltage VB2 is applied to the electrode 49 as in the apparatus 31. The operation of the apparatus 41 is illustrated by a curve A in FIG. 11.

Figure 9:
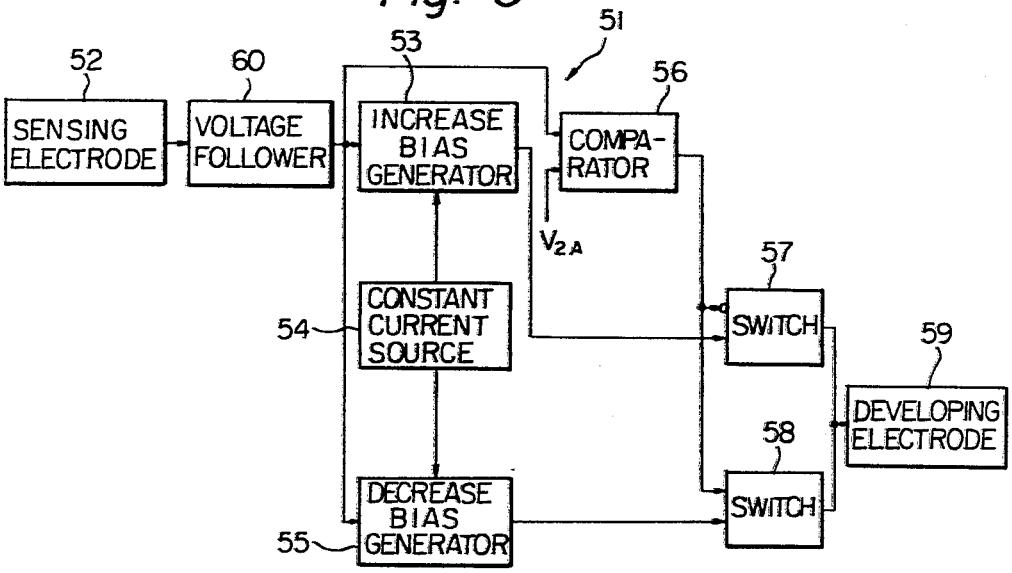
FIG. 9 is a block diagram of a third embodiment of an electrostatographic apparatus embodying the present invention.

Another electrostatographic apparatus 51 embodying the present invention is shown in FIG. 9 and comprises a sensing electrode 52 which is connected through a follower 60 to an input of a first variable bias voltage generator 53 powered by a constant current source 54. The generator 53 produces an output voltage which is proportional to the voltage on the electrode 52 and which is equal or slightly greater than the average electrostatic potential on the drum 12.

The output of the generator 53 is connected to an input of an electronic switch 57. A reference voltage V2A corresponding to the potential V2 is applied to an input of a comparator 56. The output of the follower 60 is applied to the other input of the comparator 56 and to an input of a second variable bias voltage generator 55. The output of the comparator 56 is connected to an inverting control input of the switch 57 and to a non-inverting control input of a switch 58. The output of the second variable bias voltage generator 55, which is powered by the constant current source 54, is connected to another input of the switch 58. The outputs of the switches 57 and 58 are connected to a developing electrode 59 which corresponds to the electrode 28 of the apparatus 11.

The variable bias voltage generator 55 is constructed to produce a bias voltage which decreases as the drum potential increases and which has a value of VB1 at the drum potential V2. In this case the comparator 56 produces a low output when the drum or average electrostatic image potential is below V2 to connect the generator 53 to the electrode 59. This occurs when the output of the follower 60 is below V2A. When the drum potential exceeds V2, at which time the bias voltage is VB1, the output of the comparator 56 goes high to connect the generator 55 to the electrode 59. In this manner, the bias voltage is increased progressively up to VB1 as the drum potential approaches V2 and decreased progressively as the drum potential exceeds V2. If desired, the voltage V1A may be applied to the comparator 56 rather than the voltage V2A so that the bias voltage will begin to decrease at V1.

Figure 11:
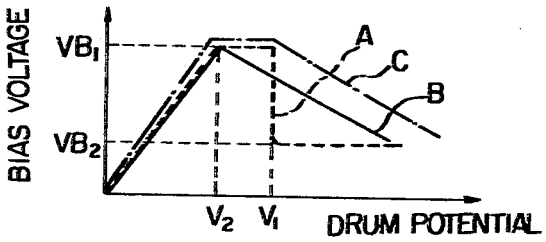
FIG. 11 is a graph illustrating the operation of the apparatus of FIGS. 8, 9 and 10.

The operation of the apparatus 51 is illustrated by a curve B in FIG. 11.

Figure 10:
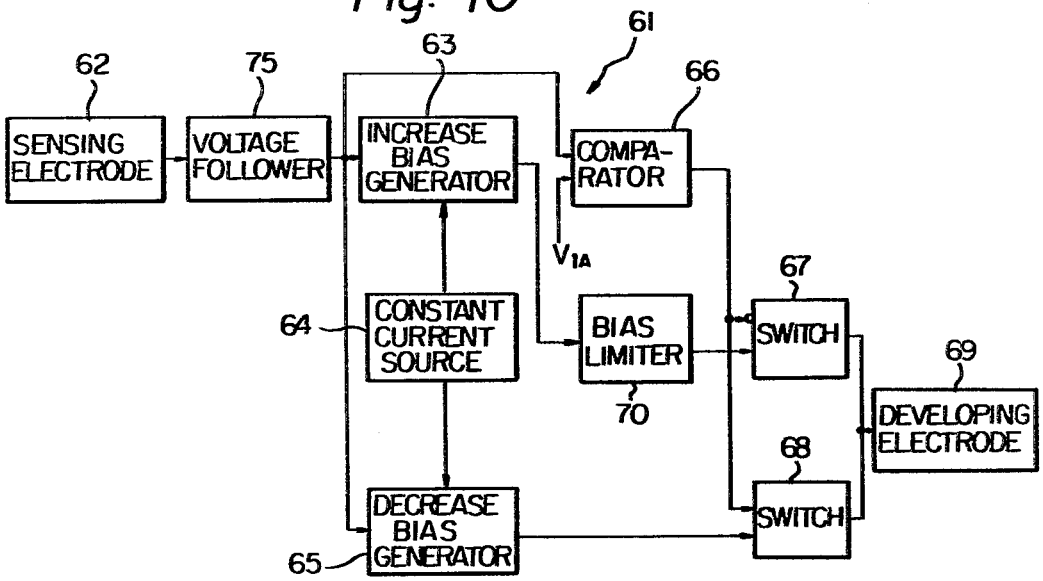
FIG. 10 is a block diagram of a fourth embodiment of an electrostatographic apparatus embodying the present invention.

Another electrostatographic apparatus 61 embodying the present invention is shown in FIG. 10 and comprises a sensing electrode 62 which is connected through a follower 75 to an input of a first variable bias voltage generator 63 powered by a constant current source 64. The generator 63 produces an output voltage which is proportional to the voltage on the electrode 62 and which is equal or slightly greater than the average electrostatic potential on the drum 12.

The output of the generator 63 is connected to an input of an electronic switch 67. A reference voltage V1A corresponding to the potential V1 is applied to an input of a comparator 66. The output of the follower 75 is connected to another input of the comparator 66 and to an input of a second variable bias voltage generator 65. The output of the comparator 66 is connected to an inverting control input of the switch 67 and to a non-inverting control input of a switch 68. The output of the second variable bias voltage generator 65, which is powered by the constant current source 64, is connected to another input of the switch 68. The outputs of the switches 67 and 68 are connected to a developing electrode 69 which corresponds to the electrode 28 of the apparatus 11. A bias limiter 70 is connected between the generator 63 and the switch 67.

The variable bias voltage generator 65 is constructed to produce a bias voltage which decreases as the drum potential increases and which has a value of VB1 at the drum potential V2. The comparator 66 produces a low output when the drum or average electrostatic image potential is below V1 to connect the generator 63 to the electrode 69. This occurs when the output of the follower 75 is below V1A. When the drum potential exceeds V1, at which time the bias voltage is VB1, the output of the comparator 66 goes high to connect the generator 65 to the electrode 69. In this manner, the bias voltage is increased progressively up to VB2 as the drum potential approaches V2 and decreased progressively as the drum potential exceeds V1.

The generator 63 is constructed so that the output thereof is VB1 when the drum potential is V2. The bias limiter 70 is constructed to limit the output voltage of the generator 63 which is applied to the electrode 6 through the switch 67 to the upper limit value VB1 although the output of the generator 63 attempts to go above VB1 as the electrostatic potential exceeds V2. Thus, the bias voltage is maintained constant at VB1 at drum potentials between V2 and V1.

In summary, it will be seen that the present invention provides an electrostatographic apparatus which overcomes the problems of the prior art and is capable of producing faithful reproduction of any type of original document such as printed or photographic documents. Various modifications will become possible for those skilled in the art after receiving the teachings of the present disclosure without departing from the scope thereof. For example, the photoconductive drum 12 may be eliminated and the electrostatic image formed directly on a sheet of photoconductive copy paper.

What is claimed is:

1. An electrostatographic apparatus including a photoconductive member, charging means for forming an electrostatic charge on the photoconductive member, imaging means for radiating a light image onto the photoconductive member to form an electrostatic image thereon and developing means for applying toner to the photoconductive member to develop the electrostatic image into a toner image, characterized by comprising:

sensing means for sensing an electrostatic potential of the electrostatic image on the photoconductive member;

bias voltage generating means for generating and applying a developing bias voltage to the developing means; and control means responsive to the sensing means for controlling the generating means in such a manner as to increase the bias voltage in accordance with the electrostatic potential until the electrostatic potential reaches a predetermined value and to decrease the bias voltage when the electrostatic potential exceeds said predetermined value.

2. An apparatus as in claim 1, in which the control means is constructed to control the generating means in such a manner as to reduce the bias voltage to a constant value below an upper limit value corresponding to the electrostatic potential at said predetermined value at all values of the electrostatic potential above said predetermined value.

3. An apparatus as in claim 2, in which the generating means comprises a variable bias voltage generator connected to the sensing means in such a manner as to generate a variable bias voltage which increases in accordance with the electrostatic potential, a fixed bias voltage generator for generating a fixed bias voltage having said constant value, comparator means for comparing the electrostatic potential with said predetermined value and switch means controlled by the comparator means in such a manner as to connect the mariable bias voltage generator to the developing means when 5ential, a fixed the electrostatic potential is below said predetermined value and to connect the fixed bias voltage generator to the developing means when the electrostatic potential is above said predetermined value.

4. An apparatus as in claim 2, in which the control means is further constructed to limit the bias voltage to the upper limit value when the electrostatic potential is between said predetermined value and a second predetermined value which is lower than said predetermined value.

5. An apparatus as in claim 4, in which the generating means comprises a variable bias voltage generator connected to the sensing means in such a manner as to generate a variable bias voltage which increases in accordance with the electrostatic potential, a fixed bias voltage generator for generating a fixed bias voltage having said constant value, comparator means for comparing the electrostatic potential with said predetermined value, switch means controlled by the comparator means in such a manner as to connect the variable bias voltage generator to the developing means when the electrostatic potential is below said predetermined value and to connect the fixed bias voltage generator to the developing means when the electrostatic potential is above said predetermined value and limiting means connected between the variable bias voltage generator and the switch means for limiting the bias voltage to the upper limit value.

6. An apparatus as in claim 1, in which the control means is constructed to control the generating means in such a manner as to progressively reduce the bias voltage below an upper limit value corresponding to the electrostatic potential at said predetermined value as the electrostatic potential increases above said predetermined value.

7. An apparatus as in claim 6, in which the generating means comprises a first variable bias voltage generator connected to the sensing means in such a manner as to generate a variable bias voltage which increases in accordance with the electrostatic potential, a second variable bias voltage generator for generating a variable bias voltage which decreases in accordance with the electrostatic potential, comparator means for comparing the electrostatic potential with said predetermined value and switch means controlled by the comparator means in such a manner as to connect the first variable bias voltage generator to the developing means when the electrostatic potential is below said predetermined value and to connect the second variable bias voltage generator to the developing means when the electrostatic potential is above said predetermined value.

8. An apparatus as in claim 6, in which the control means is further constructed to limit the bias voltage to the upper limit value when the electrostatic potential is between said predetermined value and a second predetermined value which is lower than said predetermined value.

9. An apparatus as in claim 8, in which the generating means comprises a first variable bias voltage generator connected to the sensing means in such a manner as to generate a variable bias voltage which increases in accordance with the electrostatic potential, a second variable bias voltage generator for generating variable bias voltage which decreases in accordance with the electrostatic potential, comparator means for comparing the electrostatic potential with said predetermined value, switch means controlled by the comparator means in such a manner as to connect the first variable bias voltage generator to the developing means when the electrostatic potential is below said predetermined value and to connect the second variable bias voltage generator to the developing means when the electrostatic potential is above said predetermined value and limiting means connected between the first variable bias voltage generator and the switch means for limiting the bias voltage to the upper limit value.

* * * * *